United States Patent [19]

Lefebvre

[11] Patent Number: 4,551,619

[45] Date of Patent: Nov. 5, 1985

[54] CABLE STRUCTURE FOR IMMERSION HEATERS OR THE LIKE

[76] Inventor: Fredrick L. Lefebvre, 700 Solano Prado, Coral Gables, Fla. 33156

[21] Appl. No.: 693,149

[22] Filed: Jan. 22, 1985

[51] Int. Cl.[4] ..... H05B 3/06

[52] U.S. Cl. ..... 219/523; 29/611; 29/613; 174/78; 219/528; 219/544; 219/552; 219/549; 338/214

[58] Field of Search ..... 219/318, 324, 331, 333, 219/335, 337, 437, 521, 523, 528, 541, 544, 549, 553; 174/DIG. 8, 51, 78, 75 R, 84 R; 338/214; 119/5, 318; 29/611, 619, 628; 339/14 R

[56] References Cited

U.S. PATENT DOCUMENTS

| | | | |
|---|---|---|---|
| 3,657,520 | 4/1972 | Ragault | 219/553 |
| 3,663,799 | 5/1972 | McArn | 219/523 |
| 3,674,985 | 7/1972 | Ragault | 219/523 |
| 3,691,505 | 9/1972 | Graves | 338/214 |
| 3,744,007 | 7/1973 | Horak | 174/78 X |
| 4,028,487 | 6/1977 | McLean et al. | 174/78 |
| 4,158,764 | 6/1979 | Yane | 219/523 |
| 4,163,145 | 7/1979 | Neff | 219/523 |
| 4,205,888 | 6/1980 | Wade | 339/14 R |
| 4,234,785 | 11/1980 | Lefebvre | 219/523 |
| 4,271,330 | 6/1981 | Watine et al. | 174/78 X |

*Primary Examiner*—Volodymyr Y. Mayewsky
*Attorney, Agent, or Firm*—Watts, Hoffmann, Fisher & Heinke Co.

[57] ABSTRACT

The present invention relates to the technical field of fluid heater devices, and more particularly to an electric cable structure of a composite construction adapted for use as an electric immersion heater for use in electroplating, metal preparation and finishing applications and the like, and more particularly relates to a new and novel, flexible cable structure of small diameter which can be quickly and easily produced by continuous fabricating techniques into indefinite lengths, and which may be thereafter severed into predetermined lengths for various immersion heater applications.

12 Claims, 4 Drawing Figures

CABLE STRUCTURE FOR IMMERSION HEATERS OR THE LIKE

DESCRIPTION

1. Technical Field

The present invention relates to the technical field of fluid heater devices, and more particularly to an electric cable structure of a composite construction adapted for use as an electric immersion heater for use in electroplating, metal preparation and finishing applications and the like, and more particularly relates to a new and novel, flexible cable structure of small diameter which can be quickly and easily produced by continuous fabricating techniques into indefinite lengths, and which may be thereafter severed into predetermined lengths for various immersion heater applications.

2. BACKGROUND OF THE INVENTION

Heretofore, it has been known to utilize various immersion heater designs to heat various corrosive liquids in tanks utilized in the plating and treating of metals. Such immersion heaters generally include a resistance wire and ceramic insulator assembly in a sheath of material resistant to the chemicals being heated. A general background of the various prior art heaters of the immersion type and their various features are disclosed, for example, in applicant's prior U.S. Pat. No. 4,234,785 and the patents cited therein.

Recently, it has also been recognized that fluoroplastic materials incorporate good corrosion resistant properties in respect to heating solutions in electro-plating and in similar metal preparation treating applications. However, prior immersion type heaters utilizing fluoroplastic materials, such as TEFLON or the like, have not been completely satisfactory for a number of reasons. For example, such prior devices, though utilizing TEFLON type materials but in a limited sense, have generally been difficult and time consuming to produce resulting in relatively expensive heater-type products. In addition, such prior devices have been expensive to produce resulting from the relatively large dimension (e.g. diameter) sizes used, and also have not been versatile in providing various configurations for different immersion heater applications, again due to the large diameter. That is, such prior devices have not maintained a minimum transverse dimension (diameter) to afford optimum characteristics.

For reference to prior type devices utilizing TEFLON type materials in immersion heater applications, reference may be had to U.S. Pat. Nos. 3,657,520, 3,663,799 and 4,158,764.

SUMMARY OF THE INVENTION

The present invention relates to a flexible, cable structure of small diameter adapted for use as an electric immersion heater having good temperature and corrosion resistant characteristics with the ability to be bent to a small radius without crimping of the outer sheath. This structure comprises an electric heater element adapted for connection to a power source. A sheath made from a relatively thin layer of polymeric material is disposed in close fitting relation around a heater wire element throughout its length. A conductive ground wire element is disposed adjacent to and extends throughout the length of the sheath, and a barrier layer of high temperature insulation material is disposed to encapsulate the ground wire element throughout its length. An outer tubular sheath made from a fluoropolymeric material is disposed in encompassing relation around the insulating layer throughout its length to provide the cable structure. In the invention, the finished cable structure has a maximum transverse dimension (diameter) of ⅛ inch or less with the cable structure providing a maximum surface wattage of up to 9 watts/sq.in. with the ground wire extending throughout the full length of the structure.

In the invention, the cable structure can be quickly and easily produced by continuous fabrication techniques so as to produce a product of indefinite lengths and heater wire gauges which can thereafter be readily severed into predetermined lengths to meet various voltage/KW specifications. For joining purposes, the heater wire ends, in turn, are soldered to larger size copper lead wire which may also be coated with TEFLON. Because of the relatively overall reduced cable diameter (e.g. ⅛ inch), the problems with joining shrink tubing are minimized. Because of this small diameter, the cable of the invention can be fabricated in a continuous operation and cut into predetermined lengths, and then easily joined (hot and cold ends) by shrink tubing without pin-hole formations and without the need for secondary heat seal operations to further fuse the shrink tubing as would be required with larger diameter cable or tube structures. This small diameter construction provides a flexible cable which can be readily coiled, formed and shaped without crimping to any desired immersion heater length and then simply joined to a power cable by shrink tubing, as aforesaid.

Other advantages and objects of the present invention will become apparent as the following description proceeds when taken in conjunction with the accompanying drawings.

DESCRIPTION OF THE PREFERRED EMBODIMENTS

Figure 1:
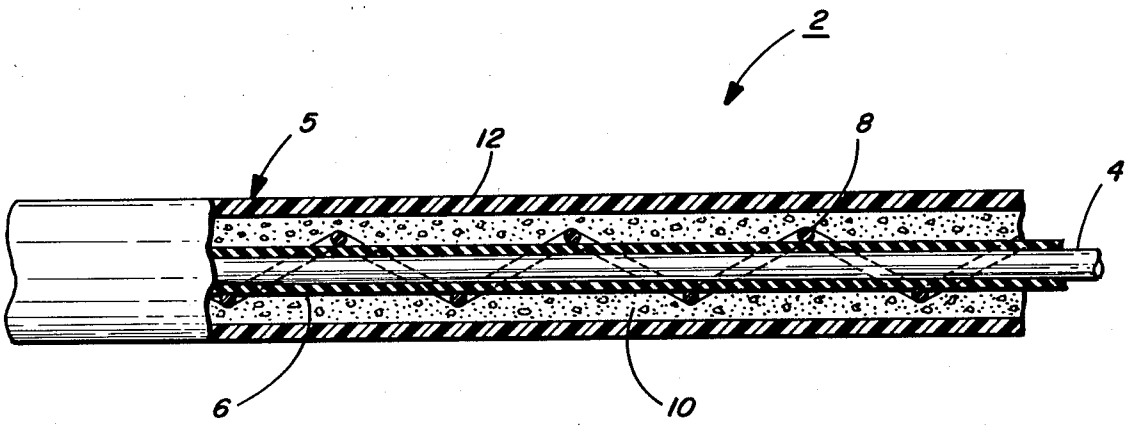
FIG. 1 is a fragmentary, horizontal section view, on an enlarged scale, illustrating the flexible cable structure made in accordance with the present invention.

Referring now again to the drawings and in particular to FIG. 1 thereof, there is illustrated the flexible cable structure, designated generally at 2, made in accordance with the present invention adapted for use as an immersion heater in plating tank operations. In general, the cable structure 2 includes an electrical heater wire 4 extending longitudinally through the structure. The heater wire 4 may be of the solid electrical resistance type made of a good heat transmitting metal alloy material. The heater wire, for example, may be 18 gauge (American or Browne & Sharp) having a diameter of approximately 0.04 inches.

In the embodiment illustrated, the heater wire 4 is covered with a layer of a fluoropolymeric material 6 which extends throughout the length thereof. The fluoropolymeric layer 6 may be made from a tape-wrap construction wherein two or more layers are disposed in overlapping relationship relative to one another throughout the length of the heater wire 4. This is then melted and heat-set by a sintering operation which may be carried out at a temperature of about 700° F., in a manner as known in the art. The coating layer 6 may also be formed by extrusion, as known in the art. In the invention, the coating layer 6 may have a wall thickness in the range between 0.01 inches to 0.025 inches for the extruded form and measured at the overlap, in the case of the wrapped construction. Accordingly, for an 18 Gauge heater wire of 0.04 inches, the resultant diameter of the fluoropolymeric coated heater wire 4 and 6 would be approximately 0.065 inches.

In the invention, the fluoropolymeric material provides good strength and good temperature and high corrosion resistant characteristics and hence, is highly suitable and preferred for electro-plating and other metal finishing applications where corrosive liquids are utilized. Typical of these fluoropolymeric materials are those commercially available under the Dupont Company's trademarks TEFLON or TEFLEX. Accordingly, in the invention the fluoropolymeric material may be a fluoroplastic selected from the group consisting of tetrafluoroethylene and fluorinated ethylene propylene polymers.

An electrical ground wire 8 is disposed adjacent to the coated heater wire 4 and 6 throughout its length thereof. The ground wire 8 is helically disposed with about two to six turns per foot and which ground wire is applied directly to the cold fluoropolymeric covered heater wire. In the invention, it is important that the ground wire be continuous and extend without interruption throughout the length of the cable structure, as distinguished from the ground wire arrangement in Yane U.S. Pat. No. 4,158,764, so as to comply with most Regional Electrical Codes. The importance of this is to enable the ground wire to shunt electrical power from the immersion heater in the event of breaking or rupture of the outer fluoropolymeric materials encapsulating the coated heater wire. This is a serious safety problem which must be considered to prevent damage or injury resulting from stray currents in the plating tank resulting in the extreme case of electrocution of the workman. Accordingly, the ground wire acts to provide a path for electrical energy in the event of any damage to the cable structure below the liquid level in the tank rather than having the electrical energy transmitted through the liquid in the tank thereby promoting a safe operating condition. Also, because of the small diameters involved, a single strand wire is completely effective as a ground leg. Yet it does not interfer with heat conductivity from the heater wire such as would be the case with a woven wire sleeve.

Now in the invention, the fluoropolymeric coated heater wire and ground wire 8 are encapsulated with a barrier layer of insulating material 10 which also acts as a fill and is sized so as to completely encapsulate the outside diameter of the ground wire thereby to provide a substantially uniform support for the outer sheath 12 of fluoropolymeric material. The barrier layer 10 of fill material is preferably made of a high temperature resistant material such as fibrous glass material, arimid (aromatic polymide) paper, such as that sold under the trade name NOMEX by the Dupont Corporation or an alumina-silica ceramic paper such as that sold under the name of FIBERFRAX by the Carburundum Corporation. This barrier layer of fill material acts as an insulation to reduce the heat transfer to the inner fluoropolymeric layer 6 during the final application (e.g. extrusion) of the outer fluoropolymeric sheath 12. The outer fluoropolymeric tubular sheath 12 is then heat extruded over the barrier layer of fill material 10 to provide the final composite cable structure.

In the invention, the outer fluoropolymeric tubular sheath 12 preferably has a wall thickness in the range between 0.01 inches and 0.025 inches with the heater wire having a diameter in the range between 0.01 inches and 0.06 inches to provide a maximum overall outside diameter (OD) of $\frac{1}{8}$ inch or less for providing a maximum heat capacity up to 9 watts/sq.in. of surface area. In such case, the finished cable structure could have a bend radius as small as $\frac{1}{2}$ inch so as to be bent into a 1 inch diameter circle. As employed herein the term "bend radius" means the radius corresponding to the curvature of a bent specimen or part, as measured at the inside surface of the bend. Accordingly, for an 18 Gauge electrical resistance heating wire, the overall diameter (OD) of the cable structure is approximately 0.10 inches and yet provides a heat capacity of from 6 watts/sq.in. of exposed surface area up to 9 watts/sq.in. of exposed surface area.

In making the flexible cable structure of the present invention, the fluoropolymeric inner coating layer 6 is simply provided by two or more tape layers which are subsequently sintered at a temperature of about 700° F. to form a homogeneous mass which is then cooled to ambient temperature (e.g. 68° F.). The electrical ground wire (tinned copper) is then helically wrapped with about 4 turns per foot directly onto the coated heater wire 4 after cooling. It has been found that no intermediate protective material (e.g. tape or the like) is required because of the high strength characteristics of the fluoropolymeric underlayment. As aforementioned, in another form the fluoropolymeric coating may be extruded directly onto the heater wire and allowed to cool, in a manner known in the art, such that the coated 18 Gauge wire would have a diameter of under approximately 0.065 inches. The ground wire is then wrapped on the heater wire followed by the barrier layer of filler material 10 which is disposed around the exposed surface of the ground wire 8 and coated heater wire with the outer fluoropolymeric tubular sheath 12 then being extruded over this composite to provide the final cable structure. Importantly, in the invention the outer fluoropolymeric sheath may be made from a lesser temperature resistant (e.g. 400° F.) material which is a thermoplastic, therefore less porous (e.g. FEP), as compared to the inner fluoropolymeric material which may have a higher temperature resistance (e.g. 500° F.) when made from TFE which is a sintered plastic, slightly more porous potential but much less expensive.

Figure 2:
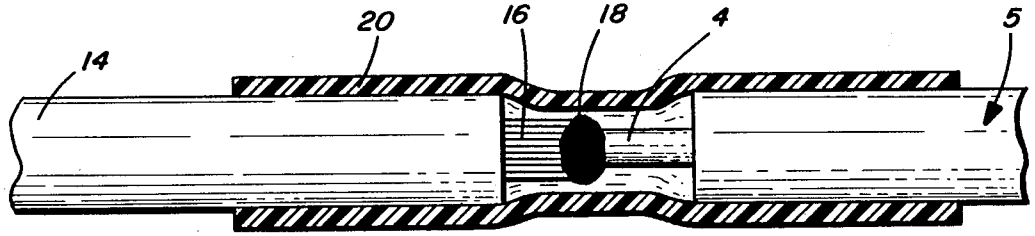
FIG. 2 is a fragmentary, side elevation view, on an enlarged scale, with parts broken away and in horizontal section illustrating one embodiment for joining a flexible cable structure made in accordance with the invention to an electrical power source.

In FIG. 2 there is illustrated one embodiment for joining the cable structure 5 (hot zone) to the abutting end of an electrical lead wire 14. This lead wire may be a tinned copper cable 16 already furnished with a fluoropolymeric (TEFLON) sheath 14. To provide the electrical connection, the heater wire 4 may be joined, as at 18, by silver soldering the lead wire 16 to the heater wire 4. This joint is then bridged by a shrink tube element 20 which may also be made from a fluoropolymeric (TEFLON) material. Preferably, the shrink tube element 20 is heat shrunk down and around the hot and cold zone areas by a sintering operation with the shrink tube element extending throughout the length of the cold zone and up to the electrical junction box 26 in FIG. 3. By this arrangement, there can be quickly and easily provided a cable structure which may be readily cut into any predetermined length or lengths of cold zones as may be required above the liquid level in the tank.

Figure 3:
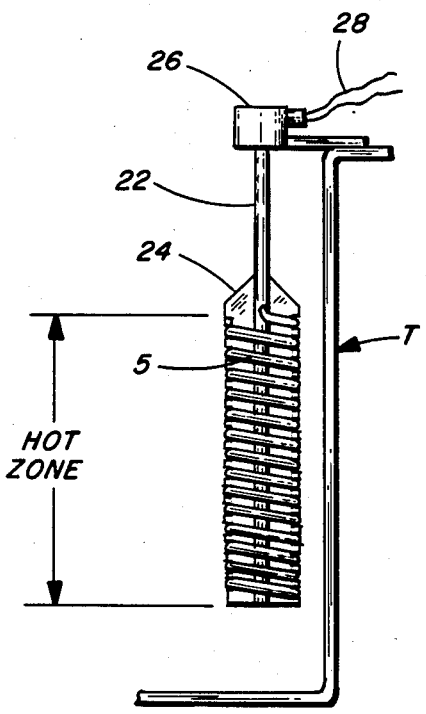
FIG. 3 is a fragmentary, generally schematic view, in side elevation and on an enlarged scale, illustrating one arrangement for supporting the flexible cable structure in a plating tank for use as an immersion heater.
Figure 4:
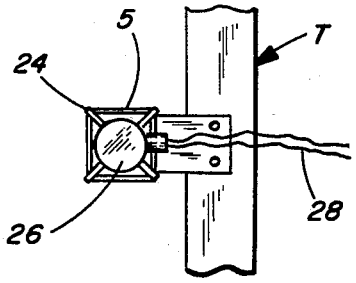
FIG. 4 is a fragmentary, top plan view of the assembly illustrated in FIG. 3.

FIGS. 3 and 4 illustrate a typical application of the cable structure 5 of the present invention for use as an immersion heater for heating liquid in a tank, designated generally at T. As shown, the cable structure 5 is mounted on a support arm 22 which, in turn, mounts a support bracket 24. This bracket 24 may be notched-out to provide carrier for the helically disposed cable structure 5. Accordingly, in this form the cable structure provides an immersion heater which defines the HOT ZONE within the tank. Suitable lead wires (not shown) may extend interiorly through the support arm 22 for electrical connection to the junction box 26, and wherein other lead wires 28 may be connected to a suitable source of AC power, as shown in applicant's prior U.S. Pat. No. 4,234,785. In this form, the bracket 24 and arm 23 may be made of a suitable corrosion resistant polymeric material, such as polypropylene and the like.

Accordingly, by the foregoing it will be seen that the present invention provides a new and improved flexible cable structure which can be quickly and easily fabricated by means of continuous extrusion/cabling techniques so as to achieve cable structures of indefinite length and various wire gauge, which can be readily severed and thereafter joined together into any predetermined length to accommodate a given immersion heater wattage, voltage and cold zone construction. In the invention, this cable structure is significantly inexpensive to fabricate and has a relatively small maximum transverse dimension (diameter) so as to afford optimum flexibility (bend radius characteristics while assuring adequate heat transfer characteristics for heating the treating solution. In essence, therefore, the present invention provides a flexible, minimum diameter cable structure made from a fluoropolymeric material which can be economically produced with good temperature resistance characteristics for use in highly corrosive applications. By this arrangement, various large KW capacities can be achieved by multiple assemblies for attachment to a common head of individual elements, yet keeping the heater wire gauge to Gauge 16 (Brown and Sharp) or less. These individual elements can be mass produced in various shapes and sizes.

Other advantages and objects of the present invention will be apparent from the foregoing description and accompanying drawings, and other equivalent arrangements and modifications are contemplated in the following claims.

I claim:

1. A flexible cable structure having a maximum diameter of $\frac{1}{8}$ inch adapted for use as an electric immersion heater having good temperature and corrosion resistent characteristics with the ability to be bent to a minimum radius, comprising an electric heater wire element adapted for connection to a power source, a sheath made from a relatively thin layer of fluoropolymeric material disposed in close fitting relation around said heater wire element throughout its length thereof, a conductive ground wire element disposed in spiral engagement with and extending substantially throughout the length of said sheath, an insulating barrier layer of high temperature insulation encapsulating said ground wire element substantially throughout its length thereof, and an outer tubular sheath made from a fluoropolymeric material disposed in encapsulating relation around said insulating barrier layer substantially throughout its length thereof to provide said cable structure.

2. A cable structure in accordance with claim 1, wherein said sheath is made from at least one layer of spirally wrapped tape disposed in overlapping relationship which has been sintered to form substantially homogeneous polymeric layer.

3. A cable structure in accordance with claim 2, wherein said sintered homogeneous polymeric layer has been cooled to ambient temperature prior to engagement with said ground wire element.

4. A cable structure in accordance with claim 2, wherein said sintered homogeneous polymeric layer is made from a plastic material selected from the group consisting essentially of tetrafluoroethylene and fluorinated ethylene propylene polymers, and which has been sintered at a temperature between 500° F. and 700° F. and then cooled to ambient temperature.

5. A cable structure in accordance with claim 1, wherein said casing is comprised of a spirally wrapped tape layer made from a fluoropolymeric material, and said fluoropolymeric material having a higher temperature resistance than the fluoropolymeric material of said outer tubular sheath.

6. A cable structure in accordance with claim 1, wherein said casing is comprised of an extruded layer of fluoropolymeric material.

7. A cable structure in accordance with claim 1, wherein said insulation is comprised of a layer of silicon rubber material, glass fiber, aramid paper or the like.

8. A method for making a composite cable structure for use with immersion heaters or the like having improved corrosion resistant and heat-transfer properties with good bend radius characteristics, said method comprising the steps of providing a solid electrical resistance wire element, encapsulating said wire element with a layer of fluoropolymeric material, disposing an electrical ground wire element in spiral engagement with said layer substantially throughout its length thereof, encasing said ground wire element with high temperature barrier insulation material, and extruding an outer tubular member made from a fluoropolymeric material around said high temperature insulation layer to provide said composite cable structure.

9. A method in accordance with claim 8, wherein said sheath includes at least one layer of spirally wrapped tape made from said fluoropolymeric material, said fluoropolymeric tape being heat-fused by sintering to provide a generally homogeneous polymeric mass, cooling said polymeric mass to ambient temperature, and then disposing said electrical ground wire element in engagement therewith.

10. A method in accordance with claim 9, including spirally wrapping said electrical ground wire element around said cooled polymeric mass substantially throughout its length thereof.

11. A method in accordance with claim 10, wherein said hollow outer tubular member is made from a fluoropolymeric plastic selected from the group consisting essentially of tetrafluoroethylene and fluorinated ethylene propylene polymers, and wherein said material has a lesser heat resistance as compared to the fluoropolymeric mass defining said sheath.

12. A method in accordance with claim 11, wherein the resultant composite cable structure has a maximum outside diameter of $\frac{1}{8}$ inch with the capacity to maintain up to 9 watts/sq.in. of sheath surface with a bend radius of $\frac{1}{2}$ inch without crimping.

* * * * *